US005219506A

United States Patent [19]

Anderson et al.

[11] Patent Number: 5,219,506

[45] Date of Patent: Jun. 15, 1993

[54] PREPARING FINE DENIER STAPLE FIBERS

[75] Inventors: Harvey G. Anderson; James V. Hartzog, both of Kinston; Harold L. Manning, Jr., Bethel; James W. Tolliver, Kinston, all of N.C.

[73] Assignee: E. I. Du Pont de Nemours and Company, Wilmington, Del.

[21] Appl. No.: 804,146

[22] Filed: Dec. 6, 1991

[51] Int. Cl.[5] ..... B29C 47/88

[52] U.S. Cl. ..... 264/143; 264/210.8; 264/211.15; 264/237; 425/72.2; 425/378.2; 425/464

[58] Field of Search ..... 264/210.8, 211.15, 210.7, 264/235.6, 237, 143, 148, 151; 425/72.2, 378.2, 464

[56] References Cited

U.S. PATENT DOCUMENTS

| | | | |
|---|---|---|---|
| 3,067,458 | 12/1962 | Dauchert | 264/211.15 |
| 3,808,302 | 4/1974 | Dyer et al. | 264/235.6 |
| 4,045,534 | 8/1977 | Fisher et al. | 264/211.15 |
| 4,153,409 | 5/1979 | Capps et al. | 425/464 |
| 4,712,988 | 12/1987 | Broaddus | 425/725 |
| 4,743,186 | 5/1988 | Schippers | 425/72.2 |
| 4,943,220 | 7/1990 | Fourne | 425/72.2 |
| 5,112,550 | 5/1992 | Gotoh et al. | 425/72.2 |

FOREIGN PATENT DOCUMENTS

| | | | |
|---|---|---|---|
| 2930553 | 2/1981 | Fed. Rep. of Germany | 425/378.2 |
| 2273886 | 2/1976 | France | 264/237 |
| 52-15692 | 5/1977 | Japan | 264/237 |
| 61-55211 | 3/1986 | Japan . | |
| 61-55212 | 3/1986 | Japan . | |
| 61-174411 | 8/1986 | Japan | 264/211.15 |
| 62-97907 | 5/1987 | Japan . | |

*Primary Examiner*—Jeffery Thurlow

[57] ABSTRACT

Fine denier polyester fibers are obtainable from polymer of low molecular weight to have improved uniformity and excellent mechanical properties by a high throughput process.

5 Claims, 3 Drawing Sheets

PREPARING FINE DENIER STAPLE FIBERS

FIELD OF THE INVENTION

This invention concerns improvements in and relating to fine denier polyester staple fibers and their manufacture and use, and their precursors and downstream products.

BACKGROUND OF THE INVENTION

Until recently, it had been desired to produce synthetic fibers to more or less match natural fibers, for supply to the textile industry for manufacture into fabrics and garments. So commercial synthetic fibers have been historically made and used for apparel at fineness levels near those of natural fibers. More recently, so called "subdenier" polyester filaments have been available commercially at finer dpfs (deniers per filament less than about 1) but performance and availability of such fine dpf cut fibers (for staple spun yarns) has been limited. This is because conventional spinning and handling technologies have been inadequate for economic production of this subdenier staple, and such fine fibers have been available commercially by expensive routes, such as bicomponent spinning, or other low productivity processes, that are not economically attractive for making commodity staple fiber. Routes to make such fine deniers have been tried, such as (a) to split side-by-side conjugated yarns, (b) to dissolve a sea component out of a sea-island conjugated yarn, (c) to flow-draw freshly-extruded undrawn filaments ("super-stretching") to reduce denier, followed by neck drawing, (d) to use conventional spinning and drawing processes, and (e) to use high speed spinning to obtain oriented fine filaments. Processes (a) and (b) require special spinning devices and are very expensive. It is difficult to produce subdenier filaments using processes (c) and (d) due to spinning and/or drawing breaks and the denier variation has been excessive in practice. The high speed spinning process (e) can be used to produce a fine filament, but this route gives fibers of lower tenacity, lower Young's modulus and higher elongation than fibers prepared by the conventional split low speed spinning and drawing techniques. Further, high speed spinning is not compatible with high cell throughputs or piddling, a step that is necessary for a high throughput split process, i.e., separate spinning and drawing processes. In addition, the low spinning cell extrusion rate is not economical for a staple process.

The present invention is concerned with the preparation of uniform, fine fibers at high productivity using the basic elements of a conventional split staple process, so the staple can then be used in staple yarn processing systems. It is known by those skilled in the melt spinning art that when the denier per filament (dpf) is reduced, the need for polymer uniformity and process control becomes extremely critical and high quality filaments cannot be produced at the same productivities and yields as normal dpfs using conventional spinning. Attempts to manufacture subdenier filament by conventional spinning technology have resulted in filament breakage in the spinning process. So it has been necessary to reduce the amount of polymer extruded or increase the number of filaments per spinneret. When the numbers of filaments are increased, filament uniformity has deteriorated and breakage has occurred. When the amount extruded has been reduced without increasing the number of filaments, a larger number of spinning cells has been required, and so the process has been economically less attractive. In addition, conventional spinning methods have not produced satisfactory fine dpf fibers from difficult-to-spin polymers, e.g. of low viscosity, so fine denier fibers of low viscosity polymers have not been commercially available (from conventional spinning techniques).

To summarize, previous polyester filament manufacturing techniques that have been disclosed in the art have been directed to fibers not suitable for staple, or to fibers with poor uniformity, or the processes used have been expensive and/or have had low productivity.

An object of the present invention is to provide fine, uniform filaments that can be spun at high cell throughputs and be drawn to uniform subdeniers and converted to staple that is suitable for apparel uses by a process that is economically attractive. Another objective is to provide a low viscosity polyester subdenier fiber that is suitable for specialty apparel end-uses.

SUMMARY OF THE INVENTION

According to one aspect of the invention, a process is provided for preparing subdenier polyester staple fiber, wherein polyester polymer of relative viscosity (LRV) in a range about 9 to 23 is melt spun into filaments through spinning capillaries, of cross sectional area, measured in $10^{-4}$ cm$^2$, of about 1.8 to 7.5, at a mass flow rate in a range about 0.19 to about 0.35 grams/min, preferably about 0.23 to about 0.33 grams/min, wherein each spinning cell contains at least about 1600 of such capillaries, and the emerging filaments are radially quenched with cooling air as they pass through a quench chamber, wherein the distribution profile of the amounts of air supplied is controlled so as to provide the freshly-extruded filaments with cooling air in a first zone immediately below the spinneret, then an increased amount of air in another zone below the first zone, and then decreasing the amount of air supplied before the filaments leave the quench chamber, whereby filaments of spun denier less than about 4 are collected at a withdrawal speed of about 650 to 2000 meters per minute and are drawn and converted into staple fiber.

According to another aspect, there is provided staple fiber, suitable for textile processing on a cotton or worsted system, of fine denier in the range about 0.5 to about 1 dtex, and of interfilament diameter uniformity less than about 7.5% CV, preferably less than about 4% CV, and of polyester polymer of relative viscosity (LRV) about 9 to 16, which lower LRV is preferred (for some end-uses) because of the known advantages. Especially useful subdenier fabrics may be obtained according to the invention from polymer of LRV about 9 to about 11.5. An LRV of about 14 has also proved advantageous.

According to another aspect of the invention, there is provided, in an apparatus for melt spinning polymer that includes a spinneret, means for passing molten polymer through the spinneret, a hollow cylindrical foraminous member positioned immediately below the spinneret and a plenum chamber supplied with a current of gas surrounding the foraminous member to form a quench chamber for the filaments to pass through to its exit, the improvement for changing the gas distribution pattern inwardly toward the filaments in the chamber to a profile defined by a low but significant gas flow in a first zone immediately below the spinneret, increasing through a larger gas flow in a second zone at a location below the first zone, and then decreasing to a lesser gas flow before the exit of the quench chamber, comprising forming said hollow foraminous member of porosity that increases from a first low porosity immediately below the spinneret through a larger porosity at said lower location and then decreases to a second low porosity at the exit of the quench chamber. This is conveniently obtained by forming the foraminous member from a perforated plate with holes of diameters and/or densities that increase from corresponding first low values through larger values at said lower location to second low values at the exit.

Thus, the profile of the amounts of air supplied as the filaments progress through the quench chamber shows an amount that progressively increases before decreasing.

DETAILED DESCRIPTION OF THE INVENTION

Figure 1:
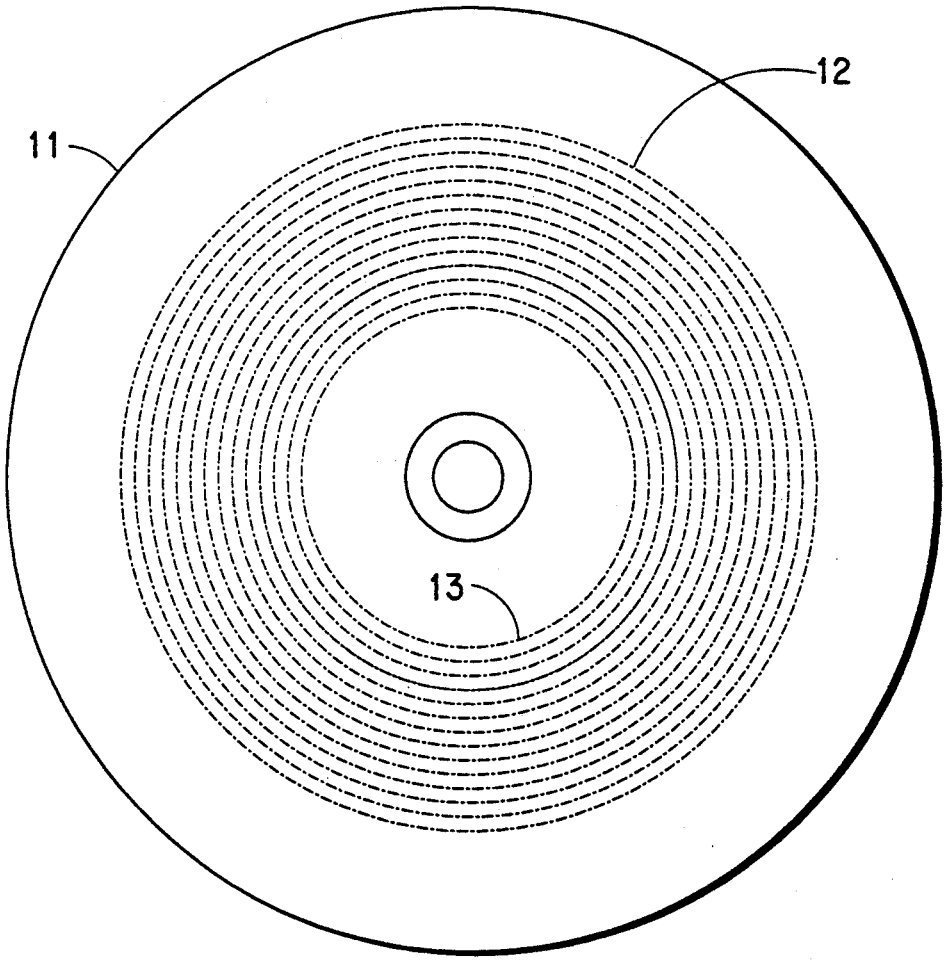
FIG. 1 is a schematic plan view of the spinneret to show a preferred capillary pattern.

The polymer used to prepare fine denier filaments of this invention is a suitable linear condensation polyester, preferably polyethylene terephthalate. The polymer may contain, for example, up to 15 percent, or more, in certain instances, of other dicarboxylates and/or dioxy glycols to provide desired properties. The polyester polymer may be modified with ionic dye sites, for example metallic sulfonated radicals such as 5-sodiumsulfoisophthalate, or other derivatives where the sodium is replaced with other alkali metal cations, to provide dyeability with cationic dyestuffs. Polyester polymers are generally selected to have a relative viscosity (LRV) in the range about 9 to 23, a zero-shear melting point greater than 240 C.; and a glass transition temperature between 40 C. and 80 C. (wherein the melting point and glass transition temperature are measured by DSC under nitrogen gas at a heating rate of 20 C. per minute). As indicated, lower viscosity polymer may be spun into fine denier filaments advantageously, according to the invention. This is desired for specialty end-uses.

The resulting drawn and cut polyester fibers preferably have a fineness in the range about 1 to 0.5 dtex, and especially in the range about 0.6 to 0.9 dtex per filament.

An important feature of the apparatus and process according to the invention is the need to provide gas flow immediately below the spinneret and to supply increasing amounts of gas as the freshly-extruded filaments start to accelerate. Thus, a low, but sufficient, amount of quenching gas should be supplied immediately below the spinneret. Then the amount of gas supplied should progressively first increase, as the filaments accelerate, through a maximum amount of quenching gas, and then decreases lower down the quench chamber. This may be accomplished by dividing the quenching system under the spinneret into three or more zones, and controlling the amounts of gas supplied in these zones, accordingly. The amounts of gas flow may be controlled conveniently by varying the sizes and/or densities of the perforations or holes in the quenching screen(s) that surround(s) the freshly-extruded filaments and through which the quenching gas passes before encountering the filaments. This is similar to the technique disclosed by Broaddus et al in U.S. Pat. No. 4,712,988, the disclosure of which is hereby incorporated by reference herein. But, according to the present invention, unlike the Broaddus apparatus, maximum gas flow should not be located in the zone immediately below the spinneret. Conveniently, a first zone, over a distance of at least 0.25 inches immediately below the spinneret should be provided with this low, but sufficient amount of quenching gas, generally air. It is the upper portion of the quench chamber that seems to be most critical. Ideally, perhaps, each successive row of perforations in the radical quenching screen could be tailored to provide the variations. However, as shown hereinafter in the Examples, we have shown a significant improvement by using three or more zones with different amounts of perforations for air flow.

The process is described with reference to the accompanying Drawings.

The polyester is melted and heated to a temperature 20 C. to 60 C. above the polymer melt temperature, filtered through an inert medium, and extruded through a spinneret capillary at a mass flow rate (w) in the range of about 0.19 to 0.35 grams per minute, preferably in the range of 0.23 to 0.33 grams per minute. A spinneret (e.g., as shown in FIG. 1) having a high spinning density per unit area is preferred. Referring to FIG. 1, such a spinneret (11) may contain 1952 capillaries, 0.007 inches diameter each, arranged in 14 circles. The circles are contained between an outer circle (12) of 4.6 inch diameter and an inner circle (13) of 2.52 inch diameter, giving a spinning density of 26 capilliaries per square centimeter. Such densities are calculated only over the annular area where the capilaries are located, i.e., not in the central area or outer locations where no capillaries are located. The capillaries are selected to have a cross-sectional area in the range of about $1.8\times10^{-4}$ cm$^2$ (28 mils$^2$) to $7.5\times10^{-4}$ cm$^2$ (115 mils$^2$), preferably in the range of $2\times10^{-4}$ cm$^2$ to $4.5\times10^{-4}$ cm$^2$, and a length such that the length/diameter ratio is in the range of about 1.17 to 5, preferably in the range of 1.2 to 2. The capillary shape can be round, or such as to provide lobal, multilobal, hollow (including multi-void) filaments.

Figure 2:
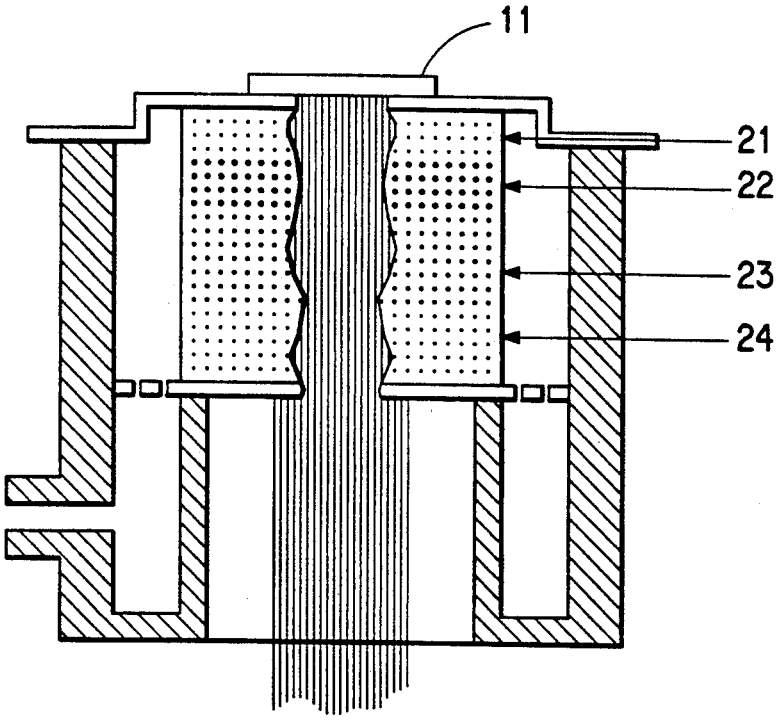
FIG. 2 is a sectional elevation view to show a preferred quench distribution chamber.

The extruded filaments pass through an air flow (quench) apparatus that is somewhat similar to that in Broaddus et al U.S. Pat. No. 4,712,988, but should be profiled to provide a low (but sufficient) air flow in the first zone (e.g., for a distance of about 1.4 inches) of the spinning way after the spinneret, followed by a higher flow in the next zone (e.g., for a distance of about 1.1 inches) of the spinning way as fiber acceleration occurs. FIG. 2 shows one apparatus that provides such an air flow profile by providing an air delivery device with a low hole density per unit area in zone 1 (21) near the spinneret (11) and by increasing the hole diameter and/or density of the subsequent zone (22). Alternatively, the hole diameter of the first zone can be decreased or the supply chamber can be modified to limit the air flow, to achieve a similar result. Zone 2 (22) is then followed, respectively by Zones 3 (23) and 4 (24), with fewer holes per unit area, as the distance from the spinneret increases. Thus, the profile of distribution of supplied air is increased as the filaments accelerate immediately below the spinneret, and this has been found important for optimum spinability and filament uniformity, when spinning large numbers of fine filaments for subdenier staple.

Figure 3:
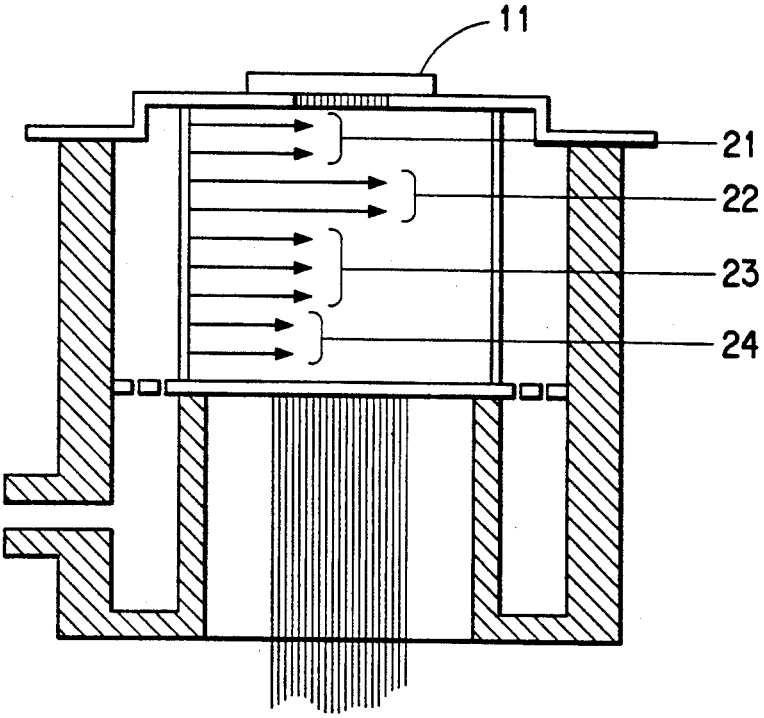
FIG. 3 is a schematic elevation view of a quench chamber showing a preferred air flow profile.

FIG. 3 shows air flow profile along the spinway attained with apparatus as shown in FIG. 2. Low air flow is provided in zone 1 (21) immediately under the spinneret to provide some cooling. An important difference from the art is that delayed quench is not desirable, as will be seen from the results in Example 1. On the other hand, we have found that too high an air flow at this location would not only lead to turbulent associated instabilities but would also increase threadline tension, leading to spinning discontinuities. These effects can become very significant with low denier filament spinning. This is a difference from the teaching of Broaddus. In the area where the filaments accelerate, high air flows are required to meet the needs of the accelerating threadline, i.e., in zone 2 (22 shown also in FIG. 3). Then, less and less additional air may be required in zones 3 and 4, respectively shown as 23 and 24 in FIGS. 2 and 3, as the filaments proceed down the quench chamber and their acceleration decreases until a steady speed of withdrawal is attained. It has proved helpful to match the filament acceleration profile and the air flow profile, to the extent shown in FIG. 3, for example, in the critical spin region using the process of the invention.

The spun polyester filaments (before drawing) are typically of dtex (or denier per filament) less than about 4, e.g., as low as about 1.25, generally up to about 3.8. The drawn filaments and staple fiber are subdenier, and preferably about 0.6 to about 0.9 dtex. Such fibers of low viscosity polymer are especially preferred, because of their advantageous properties in fabrics and garments, but have been difficult to produce economically heretofore.

After leaving the quench zone, a lubricant is applied to the filament bundle by conventional means such as a rotary roller, and the filaments from multiple spinning cells are combined and collected at speeds that are preferably 1200 to 1800, or even 1900 meters/minute. Multiple doffs are combined, drawn, heat set and cut to staple lengths using conventional polyester processes, yielding preferred fibers of 0.6 to 0.9 dtex, or denier per filament, with properties similar to standard denier products. The resulting product is processable into a staple spun yarn and fabric or filling product using conventional equipment and processes.

TEST PROCEDURES

Relative Viscosity (LRV)

The relative viscosity (LRV) is as defined in Broaddus U.S. Pat. No. 4,712,988.

Crime Takeup

The crimped rope is extended under 125 milligrams per denier load, clamped and cut at one meter length. The cut sample is mounted vertically and its length measured. Crimp takeup is calculated from the following formula, and expressed as a percentage of the extended length $$\text{Crimp Takeup} = \frac{L_e - L_r}{L_e} \times 100$$

where $L_e$ is the extended length (100 centimeters) and $L_r$ is the relaxed length (i.e., when released from the load).

Interfilament Diameter Uniformity

Cross-sectional photographs (or video images) are made of a filament bundle at 35× magnification. The diameter of each filament cross-section is measured in two directions. Ten filaments are measured for a total of twenty measurements. The average and the standard deviation of these measurements of the diameter are used to calculate the percent CV. This is listed in the Table for Example 1 under the column "UNIF." (Uniformity).

Filament Strength—Bundle Method

A section of rope is tensioned to 125 milligrams/denier and bundles of known length (longer than ten inches) of about 175 denier are selected and removed from the rope. The denier of each bundle is determined by weighing. Each sample is clamped in an Instron at a ten inch length and the crosshead is extended at a rate of 6 inches/minute. The breaking strength and elongation are calculated from the load applied and the length at the break. Five determinations are made and averaged together for each sample. Unless otherwise noted, all fiber strength data in this document is obtained via the bundle method.

Strength—Single Filament Method

The denier of a rope sample having a known number of filaments is determined by tensioning the rope at 125 milligrams/denier and weighing a one meter length. The individual filament denier is calculated from the total denier and the number of filaments. This average denier is taken as the single filament denier. Single filaments of 13 inches length are selected and carefully removed from the rope sample. Each filament is clamped in an Instron at a ten inch length and extended at a crosshead rate of 6 inches/minute. The breaking strength is calculated using the average denier. The percent length extension at break is taken as the elongation. Ten determinations are made and averaged together for each sample.

The invention is further illustrated by the following Examples:

EXAMPLE 1

Several sets of filaments were spun under different conditions from standard polyethylene terephthalate polymer of 20.4 LRV (about 0.64 IV), using a conventional melt unit in which the molten polymer is fed by a gear pump to a spinning block fitted with a filter and spinneret pack. Variations in the spinning conditions (especially quenching) are summarized in a Table, below, together with the spin operability (i.e., whether the spinning continuity was satisfactory, or inoperable because of frequent break outs, e.g., from drips) and the spun denier and uniformity of the spun filaments. The polymer was spun at a temperature of 290 degrees centigrade through a spinneret containing 1952 capillaries, arranged as in FIG. 1, with a density of 26 capillaries per square cm, each capillary with 0.007 inch diameter and 0.009 inch depth in a spinning cell having a 5.5 inch diameter. Throughput per capillary (TP/CAP in the Table) was varied from 0.232 to 0.31 gm/capillary/minute for a total spinning cell throughput (TP/CELL) varying from 60 to 80 lbs/hour.

The quench equipment used incorporated various air flow delivery or distribution systems which are referred to in the Table as follows: "Constant" indicates that similar sized perforations were provided in the foraminous distribution cylinder, after delayed quench, as indicated, for items A, B and C. "Gradient" indicates progressively decreasing air flow as described by Broaddus by progressively decreasing porosity in the cylinder, for item D. "Profile" indicates that the hole sizes are profiled to provide a moderate air flow in the 1.4 inches immediately below the spinneret (zone 1), followed by the highest air flow in the next zone (2) located at 1.5 to 2.5 inches along the cooling zone, then followed by progressively decreasing flow in succeeding zones 3 and 4, located 2.5–4.6 inches, and 4.6 to 6.5 inches, respectively, below the spinneret, as shown in FIGS. 2 and 3.

The total amount of air supplied is indicated by the air pressure, given in inches of water.

Lubricant is applied to the filament bundle with a rotary roller after the filament bundle (end) leaves the cooling zone. Spinning ends are combined and collected at withdrawal speeds that varied from 1600 to 1900 yards/min. Results are shown in the Table below.

It will be noted that the first items (A–E) all used polymer of 20.4 LRV. Of these, items A–D were comparisons, and only item E was according to the invention. Neither the constant nor the gradient system (items A–D) gave adequate operability or fiber uniformity for an acceptable process or product. On the other hand a profile system according to the process of the invention gave satisfactory operability and improved filament diameter uniformity (item E), using polymer of 20.4 LRV.

When, however, a similar profile air system was applied to low viscosity polyester (items F–L), satisfactory products and process were only obtained in items I, J, and K, when higher throughputs/capillary of 0.31 gm/min were used. Fibers spun under these conditions could only be drawn and heat set to a final denier per filament of 0.8, whereas lower deniers would also be desirable. Items L–N further show that it is necessary to match the total air supply to the acceleration of the filaments, even while using the profiled flow, to obtain satisfactory spinning performance and fiber uniformity with the difficult-to-spin 10 LRV polyester, especially to obtain low spun deniers, as indicated for these items. Items O–U confirm that ranges of throughputs and spinning speeds that are acceptable with such matched air profiles increased when the profiled air flow system is used and the total air flow (supply pressure) is matched with the needs of the total filament bundle, e.g., to avoid back drafts. These are increasingly critical as the denier is reduced and the spinning density is increased.

EXAMPLE 2

Polyethylene terephthalate of relative viscosity (LRV) 20.4 was melt spun and collected according to the invention essentially as in Example 1, at 1656 yards/min. A profiled air flow assembly that provides cooling air at a moderate flow in from the first 1.4 inches beneath the spinneret followed by a higher air flow in the subsequent 1.1 inches is supplied from a chamber of air at 0.8 inches water pressure. Multiple ends of the spun bundles are drawn on a conventional polyester draw machine, crimped with a stuffer box crimper, heat set at 130° C. for eight minutes and cut to 1.5 inch lengths, to provide subdenier staple fiber that is suitable for processing via cotton yarn manufacturing systems.

| | ITEM 1 | ITEM 2 |
|---|---|---|
| Spin cell throughput, lbs/hr | 60.6 | 70.0 |
| Spinneret hole density #/cm$^2$ | 26 | 26 |
| Capillary throughtput, gm/min | 0.24 | 0.27 |
| Spundenier/filament | 1.40 | 1.62 |
| Spinning performance | Good | Good |
| Number ends combined | 721 | 555 |
| Draw Ratio | 2.25 | 2.35 |
| Draw Temperature, °C. | 95 | 95 |
| Draw Speed, yards/min | 250 | 250 |
| Oven Temperature, °C. | 130 | 130 |
| Denier/filament | 0.66 | 0.79 |
| Tenacity, grams/denier | 3.4 | 3.4 |
| Elongation, % | 22.7 | 26.2 |
| Modulus at 10% elongation | 1.2 | 1.3 |
| Crimps/inch | 14.3 | 14.8 |
| Crimp take-up | 29.0 | 29.0 |

EXAMPLE 3

Polyethylene terephthalate is modified with two percent sodium-3,5-dicarbomethoxybenzene sulfonate to give a polymer with viscosity of 13.2 LRV. The resulting polymer is spun essentially as in Examples 1 and 2, but at a temperature of 280 degrees Centigrade at a throughput of 70 pounds per hour and a spin speed of 1700 yards per minute. The cooling system used was the aforementioned profiled system. Spinning ends were collected on tubes and 40 tubes were combined for introduction to a conventional polyester draw assembly. Subdenier fibers of 0.85 denier per filament having cationic dyeability, good spinning performance and excellent physical properties are obtained. Physical properties and process conditions are given below:

| | |
|---|---|
| Spun denier/filament | 1.57 |
| Spun filament uniformity, % | 9.15 |
| Draw ratio | 2.63 |
| Draw speed, yards/min | 79 |
| Denier/filament | 0.85 |
| *Tenacity, grams/denier | 2.84 |
| *Elongation, % | 36.5 |
| Crimps/inch | 16 |
| Crimp Takeup | 30.1 |

*10 inch single filament method

EXAMPLE 4

Polyethylene terephthalate modified with 0.15 weight percent tetraethylsilicate to increase melt viscosity was spun essentially as Example 1, using profile air flow according to the invention. Polymer of 14 LRV was spun at a temperature of 280 degrees Centigrade at throughput per capillary of 0.283 grams/minute and total spinning cell throughput of 73 pounds per hour, and collected at 1500 yards per minute. The spun supply was drawn at a 2.79× draw ratio, heated 6.8 seconds at 165° C. while held at constant length, lubricant applied and dried at 70° C. for eight minutes. The resulting rope was cut to 1.5 inch length staple and could be processed on cotton system processing equipment to produce a low pilling, soft, desirable fabric. Fiber properties obtained are:

| | |
|---|---|
| Spun denier per filament | 1.86 |
| Denier per filament | 0.70 |
| Tenacity, grams/denier | 3.2 |
| Elongation, % | 10.8 |
| Tenacity at 10% elong. | 3.2 |
| Crimps/inch | 12.2 |

-continued

| | |
|---|---|
| Crimp Take-up | 23 |

EXAMPLE 5

Low molecular weight polyethylene terephthalate (10.0 LRV) was prepared in a conventional ester interchange and polycondensation reaction with the addition of 0.33 weight percent tetraethyl silicate to boost melt viscosity and spun, essentially as in Example 4. The filaments were wound on packages at a speed of 1380 yards per minute using a conventional bobbin wind-up. Bundles of these filaments were collected together, drawn, crimped, and heat-set to form a tow of about 66,000 denier. Seventeen ends of the tow were supplied to a Seydel 677 stretch-break converter set at a total draft of 4.54. The resulting sliver had an average fiber length of 3.7 inches, suitable for processing on the worsted yarn system. Fiber properties of the stretch-broken sliver were measured (modified for the short fiber length) as follows:

| | |
|---|---|
| Denier/filament | 0.71 |
| Tenacity, grams/denier | 3.30 |
| Elongation, % | 11.1 |

EXAMPLE 6

Polyethylene terephthalate containing 0.33 weight percent tetraethylsilicate was prepared at 10 LRV and melt spun essentially as in Example 4, at a capillary throughput of 0.27 grams per capillary per minute to give a spun denier per filament of 1.78. Ends from sixteen spinning cells were combined and collected in a common container at 1500 yards per minute. A creel containing multiple cans is fed to a conventional polyester draw machine to produce a 900,000 denier rope. After drawing 2.88×, a lubricant is applied and the resulting rope is heat set at 130 C. to stabilize the structure. The rope is cut to cotton lengths (1.5 inch) and processed on cotton yarn spinning equipment to produce a yarn and fabric with exceptional softness, drape, and pilling performance. Process conditions and product properties were:

| | |
|---|---|
| LRV | 10.0 |

-continued

| | |
|---|---|
| Throughput/cell, lbs/hr | 70 |
| Spin speed, yards/min | 1500 |
| Spun denier | 1.78 |
| Spun yarn uniformity, % CV | 4.19 |
| Draw ratio | 2.88 |
| Denier/filament | 0.66 |
| Tenacity grams/denier | 3.1 |
| Elongation, % | 21.9 |
| Tenacity at 10% elong. | 1.8 |
| CPI | 10.4 |
| Crimp takeup, % | 27.0 |

EXAMPLE 7

Polyethylene terephthalate at 20 LRV was prepared and spun essentially as in Example 1, at a throughput per capillary of 0.23 grams per capillary per minute for a spinning cell throughput of 59.3 pounds per hour. The yarns are cooled using a low air flow beneath the spinneret, followed by a higher air flow in the subsequent cooling zone. A lubricant containing 1.6% sodium hydroxide is applied to the fiber bundle and the resulting fiber bundle was collected on a bobbin at 700 yards per minute to give a spun denier per filament of 3.24. Sixty bobbins were fed to 98 C. water bath, where they were first extended without orientation 4.39×, then drawn 2.68× first at a temperature of 40° C., followed by a final draw of 1.18× at 98° C. The fiber bundle is heated to 175° C. for 5.1 seconds while held at constant length. Physical properties are:

| | |
|---|---|
| Denier per filament | 0.25 |
| *Tenacity, grams/denier | 3.20 |
| *Elongation, % | 19.7 |
| *Tenacity at 10% elong. | 2.4 |

*10 inch single filament method

In similar fashion, it is possible, if desired, to reduce denier of any of the filaments of the invention, as described by Pace in U.S. Pat. No. 2,578,899, referred to as "super-stretching", and by Most in U.S. Pat. No. 4,444,710, to increase void content of hollow filaments.

It will be understood that, in addition to the fine denier staple fiber obtained according to the invention, precursor filament tows, slivers and other precursor filamentary products are also included according to the present invention, as are downstream products, in the form of garments or fabrics, for example, or fillings and filled articles, as desired.

TABLE

| ITEM | LRV | QUENCH DELAY | HOLE SIZE | AIR SUPPLY IN WATER | TP/CAP G/Min | SPEED YPM | SPUN DENIER | UNIF. % CV | SPIN OPERABILITY |
|---|---|---|---|---|---|---|---|---|---|
| A | 20.4 | 2.4 | CONSTANT | 1.8 | 0.248 | 1900 | 1.36 | 61.0 | INOPERABLE |
| B | 20.4 | 1.4 | CONSTANT | 1.8 | 0.248 | 1900 | 1.36 | 40.8 | INOPERABLE |
| C | 20.4 | 0 | CONSTANT | 1.8 | 0.248 | 1900 | 1.32 | 30.0 | INOPERABLE |
| D | 20.4 | 1 | GRADIENT | 1.2 | 0.248 | 1900 | 1.31 | 47.5 | INOPERABLE |
| E | 20.4 | 0 | PROFILE | 1.2 | 0.248 | 1900 | 1.33 | 9.7 | SATISFACTORY |
| F | 10.0 | 0 | PROFILE | 1.2 | 0.271 | 1600 | 1.67 | — | DRIPS |
| G | 10.0 | 0 | PROFILE | 1.2 | 0.271 | 1700 | 1.57 | — | DRIPS |
| H | 10.0 | 0 | PROFILE | 1.2 | 0.271 | 1800 | 1.48 | — | INOPERABLE |
| I | 10.0 | 0 | PROFILE | 1.2 | 0.310 | 1600 | 1.91 | — | OPERABLE |
| J | 10.0 | 0 | PROFILE | 1.2 | 0.310 | 1700 | 1.8 | — | OPERABLE |
| K | 10.0 | 0 | PROFILE | 1.2 | 0.310 | 1800 | 1.7 | — | OPERABLE |
| L | 10.0 | 0 | PROFILE | 1.2 | 0.232 | 1800 | 1.27 | — | INOPERABLE |
| M | 10.0 | 0 | PROFILE | 0.8 | 0.232 | 1800 | 1.27 | — | SATISFACTORY |
| N | 10.0 | 0 | PROFILE | 0.5 | 0.232 | 1800 | 1.27 | — | UNSTABLE |
| O | 10.0 | 0 | PROFILE | 0.8 | 0.310 | 1800 | 1.72 | 5.5 | SATISFACTORY |
| P | 10.0 | 0 | PROFILE | 0.8 | 0.310 | 1700 | 1.84 | 4.7 | SATISFACTORY |
| Q | 10.0 | 0 | PROFILE | 0.8 | 0.310 | 1600 | 1.98 | 3.9 | SATISFACTORY |
| R | 10.0 | 0 | PROFILE | 0.8 | 0.271 | 1800 | 1.57 | 6.7 | SATISFACTORY |

TABLE-continued

| ITEM | LRV | QUENCH DELAY | HOLE SIZE | AIR SUPPLY IN WATER | TP/CAP G/Min | SPEED YPM | SPUN DENIER | UNIF. % CV | SPIN OPERABILITY |
|---|---|---|---|---|---|---|---|---|---|
| S | 10.0 | 0 | PROFILE | 0.8 | 0.271 | 1700 | 1.59 | 4.2 | SATISFACTORY |
| T | 10.0 | 0 | PROFILE | 0.8 | 0.271 | 1600 | 1.72 | 5 | SATISFACTORY |
| U | 10.0 | 0 | PROFILE | 0.8 | 0.232 | 1800 | 1.49 | 4.6 | SATISFACTORY |

What we claim:

1. A process for preparing subdenier polyester staple fiber, wherein polyester polymer of relative viscosity (LRV) in a range about 9 to 23 is melt spun into filaments through spinning capillaries, of cross sectional area, measured in $10^{-4}$ $cm^2$, of about 1.8 to 7.5, at a mass flow rate in a range about 0.19 to 0.35 grams/min, wherein each spinning cell contains at least 1600 of such capillaries, and the emerging filaments are radially quenched with cooling air as they pass through a quench chamber, wherein the distribution profile of the amounts of air supplied is controlled so as to provide the freshly-extruded filaments with cooling air in a first zone immediately below the spinneret, then an increased amount of air in another zone below the first zone, and then decreasing the amount of air supplied before the filaments leave the quench chamber, whereby filaments of spun denier less than about 4 are collected at a withdrawal speed of about 650 to 2000 meters per minute and are drawn and converted into staple fiber.

2. A process according to claim 1, wherein the relative viscosity (LRV) is about 9 to 16.

3. A process according to claim 1, wherein the relative viscosity (LRV) is about 9 to 11.5.

4. A process according to claim 1, wherein the mass flow rate per spinning capillary is about 0.23 to 0.33 grams/min.

5. A process according to claim 1, wherein the filaments are spun at a spinning density of at least 21 spinning capillaries per square centimeter.

* * * * *